US005686943A

United States Patent [19]

Kneezel et al.

[11] Patent Number: 5,686,943

[45] Date of Patent: Nov. 11, 1997

[54] INK JET PRINTER HAVING TEMPERATURE SENSOR FOR PERIODIC CONTACT WITH PRINTHEAD

[75] Inventors: Gary A. Kneezel; Robert V. Lorenze, both of Webster; Thomas P. Courtney, Fairport; Thomas J. Wyble; Joseph J. Wysocki, both of Webster; Richard V. LaDonna, Fairport; Juan J. Becerra, Webster; Thomas E. Watrobski, Penfield, all of N.Y.

[73] Assignee: Xerox Corporation, Stamford, Conn.

[21] Appl. No.: 345,654

[22] Filed: Nov. 25, 1994

[51] Int. Cl.[6] ..... B41S 29/38

[52] U.S. Cl. ..... 347/17; 347/22; 347/32

[58] Field of Search ..... 347/14, 19, 17, 347/22, 29, 32, 18

[56] References Cited

U.S. PATENT DOCUMENTS

| | | | |
|---|---|---|---|
| Re. 32,572 | 1/1988 | Hawkins et al. | 156/626 |
| 4,571,599 | 2/1986 | Rezanka | 346/140 R |
| 4,899,180 | 2/1990 | Elhatem et al. | 346/140 R |
| 4,980,702 | 12/1990 | Kneezel et al. | 346/140 R |
| 5,107,276 | 4/1992 | Kneezel et al. | 346/1.1 |
| 5,223,853 | 6/1993 | Wysocki et al. | 346/1.1 |
| 5,257,044 | 10/1993 | Carlotta et al. | 346/140 R |

*Primary Examiner*—Benjamin R. Fuller
*Assistant Examiner*—Craig A. Hallacher

[57] ABSTRACT

An ink jet printer has a temperature sensor as a permanent part thereof to measure the temperature of printheads which are an integral part of a replaceable printhead cartridge assembly. The temperature sensor is a part of the maintenance station and senses the temperature of the printheads each time the printhead enters the maintenance station. In the preferred embodiment, the temperature sensor is spring-loaded and is located at a printhead spitting location between fixed wiper blades and the capping location in the maintenance station, so that temperature is sensed each time the printhead enters and leaves the maintenance station to eject nozzle cleaning droplets onto a collection surface at the spitting location to clean the printhead nozzle face by the wiper blades, or to cap the printhead nozzles. To facilitate good thermal contact, a recess is provided in the heat sink upon which the printhead resides for entry by the spring-loaded temperature sensor.

5 Claims, 2 Drawing Sheets

INK JET PRINTER HAVING TEMPERATURE SENSOR FOR PERIODIC CONTACT WITH PRINTHEAD

BACKGROUND OF THE INVENTION

This invention relates to thermal ink jet printers and more particularly to a thermal ink jet printer having a temperature sensor as a permanent part of the maintenance station therefor, so that the temperature of the printheads of replaceable ink cartridges may be measured each time the printhead enters and/or leaves the maintenance station.

The ink droplet ejecting performance of thermal ink jet printheads is temperature dependent. As temperature increases, so does the volume of the ink ejected. Moreover, at sufficiently high temperatures, air ingestion causes unreliable droplet ejection, leading to missing ink spots on the recording medium. Methods have been devised to compensate for printhead temperature variations and the thermal effects created by the temperature variations. These methods include modifying the electrical pulses to the droplet ejecting heating elements in response to the temperature of the printhead to keep the droplet volume and thus spot size more constant regardless of printhead temperature and also to suppress air ingestion. The electrical pulses are generally modified by varying the electrical pulse width and/or amplitude. Another method to compensate for thermal effects on printheads includes applying heat to the printhead when it is too cold, such as, by applying subthreshold pulses to the heating elements which are not capable of ejecting droplets. Most of the methods for compensating for printhead thermal effects require an accurate measurement of printhead temperature. One known method of providing a temperature reading for a printhead is to fabricate a temperature sensor or measuring device, such as a thermistor, directly on the thermal ink jet printhead die. The fabrication is economical, but in some applications it may be difficult to have a known thermal response of the sensor without calibrating each part. Another method is to bond a temperature measuring device directly to the printhead. In some applications, such as, for example, in printers which use disposable printhead cartridges, it is not economical to bond a sensor to each printhead. It is more economical to incorporate a permanent temperature measuring device into the printer, so that it is not thrown away each time the cartridge with the printhead is disposed. Generally, such a temperature measuring device in the printer is only capable of measuring ambient printer temperature, because the temperature measuring device does not contact the printhead. There is significant self-heating in a thermal ink jet printhead, so that the printhead temperature is somewhat different than ambient temperature. Thus, temperature prediction algorithms must be used based on ambient temperature and the printhead usage rate, whenever the ambient printer temperature is used. However, it is not easy to make such algorithms quantitatively accurate for all usage and ambient conditions.

U.S. Pat. No. 4,899,180 to Elhatem, et al. discloses an ink jet printhead having integrated into it a number of heating elements and a temperature regulating circuit to heat the printhead to its optimum operating temperature within seconds of turn-on and thereafter maintain that temperature.

U.S. Pat. No. 4,980,702 to Kneezel et al. discloses a printhead bonded to a heat sinking substrate having a recess formed therein. Two layers of resistive material, separated from each other by a dielectric layer, are formed in the recess by a thick film screen print process which functions respectively as a heater and a temperature sensor. The recess underlies the printhead which is bonded to the substrate. The arrangement provides good proximity of the heater and the temperature sensor to the printhead, thereby enabling accurate temperature measurements and efficient printhead heating.

U.S. Pat. No. 5,075,276 to Kneezel discloses an ink jet printhead fabricated with a resistive temperature sensor formed adjacent the heating elements. In the preferred embodiment, the sensor and heating elements are the same material. The resistive value of the sensor is established by a trimming operation while the printhead is at a specified set temperature. This technique provides the accuracy of the sensor or thermistor required which was otherwise not possible when the thermistor was formed in close proximity to the printhead and of the same material as the heating elements.

U.S. Pat. No. 5,107,276 to Kneezel et al. discloses a thermal ink jet printer having a printhead maintained at a substantially constant operating temperature during printing. Printhead temperature fluctuations are prevented by selective heating of the heating elements not being used to eject droplets with energy pulses having insufficient magnitude to eject droplets.

U.S. Pat. No. 5,223,853 to Wysocki et al. discloses a method of controlling the spot sizes printed by a thermal ink jet printer. The temperature of the ink in the printhead is sensed and a combination of power level and time duration of the electrical input signal to the heating elements is selected by entering the sensed temperature of the ink into a predetermined function relating to the energy of the input signal to the corresponding resulting size of the spot on the copy sheet.

SUMMARY OF THE INVENTION

It is an object of the present invention to incorporate a temperature measuring device or sensor into a thermal ink jet printer as a permanent part thereof which periodically makes good thermal contact with the printhead of a replaceable cartridge.

In the present invention, an ink jet printer has a temperature sensor as a permanent part thereof to measure the temperature of printheads which are an integral part of a replaceable ink cartridge. The temperature sensor may be made a part of the maintenance station and senses the temperature of the printheads each time the printhead enters the maintenance station. In the preferred embodiment, the temperature sensor is spring-loaded and is located at a printhead spitting location between fixed wiper blades and the capping location in the maintenance station, so that the temperature is sensed each time the printhead enters and leaves the maintenance station to eject nozzle clearing droplets onto a collection surface at the spitting location, to clean the printhead nozzle face by the wiper blades, or to cap the printhead nozzles. To facilitate good thermal contact, a recess is provided in the heat sink upon which the printhead resides for entry by the spring-loaded temperature sensor.

A more complete understanding of the present invention can be obtained by considering the following detailed description in conjunction with the accompanying drawings, wherein like parts have like index numerals.

DESCRIPTION OF THE PREFERRED EMBODIMENT

Figure 1:
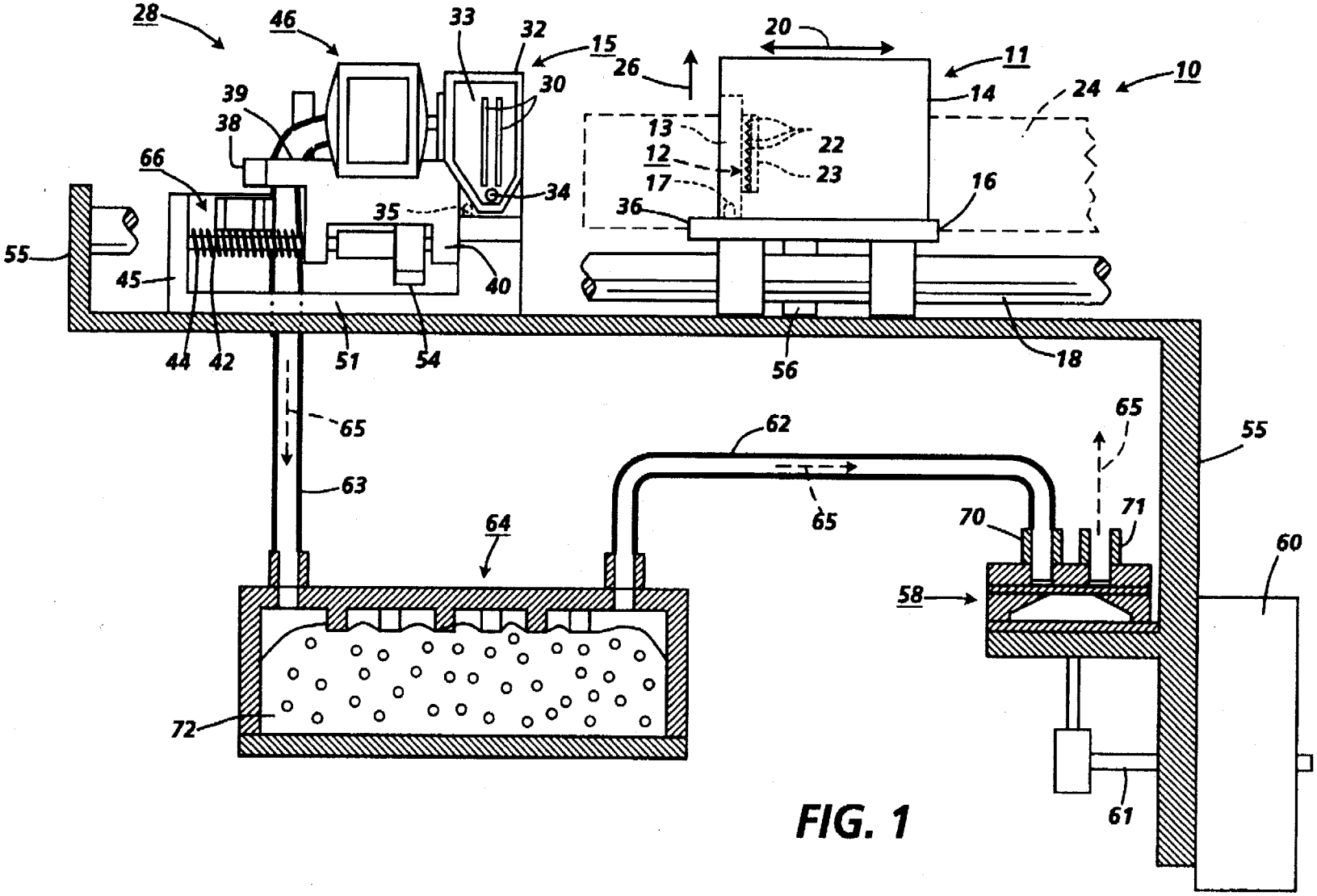
FIG. 1 is a schematic front elevation view of a partially shown ink jet printer showing a replaceable printhead cartridge assembly on a translatable carriage and the maintenance station incorporating the stationary spring-loaded temperature sensor of the present invention.

The printer 10 shown in FIG. 1 has a printhead 12, shown in dashed line, which is fixed to ink supply cartridge 14 to form a printhead cartridge assembly 11. The cartridge assembly is removably mounted on carriage 16, and is translatable back and forth on guide rails 18 as indicated by arrow 20, so that the printhead and cartridge move concurrently with the carriage. The printhead contains a plurality of ink channels (not shown) which terminate in nozzles 22 in printhead face 23 (both shown in dashed line) and carry ink from the cartridge to respective ink ejecting nozzles. When the printer is in the printing mode, the carriage translates or reciprocates back and forth across and parallel to a printing zone 24 (shown in dashed line) and ink droplets (not shown) are selectively ejected on demand from the printhead nozzles onto a recording medium (not shown), such as paper, in the printing zone, to print information thereon one swath at a time. During each pass or translation in one direction of the carriage 16, the recording medium is stationary, but at the end of each pass, the recording medium is stepped in the direction of arrow 26 for the distance of the height of one printed swath. For a more detailed explanation of the printhead and printing thereby, refer to U.S. Pat. Nos. 4,571,599 and Re. 32,572, the relevant portions of which are incorporated herein by reference.

At one side of the printer, outside the printing zone, is a maintenance station 28. At the end of a printing operation or termination of the printing mode by the printer 10, the carriage 16 is first moved past the wiper blade cleaning assembly 15 comprising two releasably mounted wiper blades 30 in a fixed structural member 32, so that the printhead nozzle face 23 is wiped free of ink and debris every time the cartridge with fixedly attached printhead enters or exits the maintenance station. Adjacent the wiper blades in the direction away from the printing zone at a predetermined location along the translating path of the cartridge is a collection surface 33 on the structural member 32. The carriage will position the cartridge at this collection surface, sometimes referred to as a spit station or spittoon, after the cartridge has been away from the maintenance station for a specific length of time, even if continually printing, because not all nozzles will have ejected enough ink droplets to prevent the ink or meniscus in the little used nozzles from drying and becoming too viscous. Accordingly, the cartridge will be moved by, for example, a carriage motor (not shown) under the control of the printer controller (not shown) past the wiper blade assembly 15, cleaning the nozzle face, and to the predetermined location confronting the collection surface 33, whereat the printer controller causes the printhead to eject a number of ink droplets per nozzle therein. Ink deposited on the collection surface, which is substantially parallel to the printhead nozzle face and vertically oriented, is caused to move under the force of gravity towards the lower portion thereof, where an opening 34 is located for the ink to drain therethrough into a pad of absorbent material (not shown) behind the collection surface 33 of the structural member 32.

Also, in the structural member 32 at a location aligned with and directly below the collection surface 33 is spring-loaded temperature sensor 35. Any suitable temperature sensor will suffice, such as, for example, thermistors or thermocouples. When the cartridge is positioned so that the printhead nozzles 22 confront the collection surface, a tapered recess 17 in the edge of the heat sink 13, on which the printhead 12 is bonded to form a printhead assembly, receives the temperature sensor 35, as more fully discussed later. Thus, each time the printhead nozzles 22 are capped (as explained later), the temperature sensor enters the heat sink recess and senses the temperature thereof. Because of the intimate contact and close proximity of the recess 17 in the heat sink 13 to the printhead 12 bonded thereto, the temperature of the heat sink is substantially the same as that of the printhead itself.

When the carriage 16 continues along guide rails 18 beyond the structural member 32 for a predetermined distance, the carriage actuator edge 36 contacts the catch 38 on arm 39 of the cap carriage 40. Cap carriage 40 has a cap 46 and is reciprocally mounted on guide rail 42 for translation in a direction parallel with the carriage 16 and cartridge mounted thereon. The cap carriage is biased towards the structural member 32 by spring 44 which surrounds guide rail 42. The cap is adapted for movement from a location spaced from the plane containing the printhead face to a location wherein the cap intercepts the plane containing the printhead nozzles in response to movement by the cap carriage. After the carriage actuator edge 36 contacts the catch 38, the print cartridge carriage and cap carriage move in unison to a location where the cap is sealed against the printhead face. At this location, the cap tightly seals the cap around the nozzles. During this positioning of the cap against the printhead face, the cap carriage is automatically locked to the cartridge by pawl 54 in cooperation with pawl lock edge 56 on the carriage 16. This lock by the pawl together with the actuator edge 36 in contact with catch 38 prevents relative movement between the cap 46 and the printhead face 23.

Once the printhead face 23 is capped and the cap 46 is locked to the cartridge 14, the printer controller may optionally cause the printhead 12 to eject a predetermined number of ink droplets into the cap for the purpose of increasing humidity in the sealed internal space within the cap.

A typical diaphragm vacuum pump 58 is mounted on the printer frame 55 and is operated by any known drive means, but in the preferred embodiment, the vacuum pump is operated by the printer paper feed motor 60 through motor shaft 61, since this motor does not need to feed paper during printhead maintenance, and this dual use eliminates the need for a separate dedicated motor for the vacuum pump. The vacuum pump is connected to the cap 46 by flexible hoses 62,63 and an ink separator 64 is located intermediate the cap and vacuum pump.

The cartridge 14, through engagement of the carriage actuator edge 36 and catch 38 of the cap carriage 40, will cause the printhead face 23 to be capped, but the tube 63 will not be pinched shut by pinch valve 66. This will be referred to as the capped position, and the nozzle face is subjected to humidified, ambient pressure air through the cartridge vent (not shown) and vacuum pump valves 70,71 through separator 64. For more detailed information on the capping of the printhead face, which is not a part of this invention, refer to U.S. Pat. No. 5,257,044.

When it is necessary to prime the printhead, the carriage 16 containing the cartridge is moved from the capped position towards fixed support member 45 which extends from base 51 removably attached to printer frame 55. At this location the pinch valve 66 closes flexible hose 63 by movement of the carriage 16. Paper feed motor 60 is energized and diaphragm vacuum pump 58 evacuates the separator 64, partially filled with an absorbent material, such as reticulated polyurethane foam 72, and connecting hoses 62,63 to a negative pressure of about minus 120 inches of $H_2O$ as indicated by arrow 65. Meanwhile, the cap 46 is still at ambient pressure because of the closure of hose 63 by pinch valve 66. After about 18 seconds, the carriage 16 and cap carriage 40 are returned to the location where the nozzle face is still capped, but the flexible hose 63 is no longer pinched closed; i.e., in the capped position. Spring 44 always biases the cap carriage away from support member 45, so when the print cartridge carriage 16 moves in a direction away from support member 45, the cap carriage follows. At this point, the cap is still sealed to the printhead nozzle face and the pinch valve is opened thereby subjecting the sealed cap internal recess to a negative pressure of minus 120 inches of $H_2O$, which causes the suction removal of about 0.2 cc± of ink. After about one second, the carriage 16 then moves in a direction towards the printing zone, breaking the cap seal and stopping the priming. The cap pressure drops and returns to ambient. The cartridge is moved by carriage 16 past the wiper blades 30, in the cleaning assembly 15, to a hold position between the cleaning assembly and the printing zone 24 for a predetermined time period to wait while the ink and air are sucked or purged from the cap to the separator. When this has been accomplished, the carriage returns the cartridge to the capped position past the cleaning assembly 15, so that the nozzle is cleaned again, to await for a printing mode command from the printer controller. Each time the print cartridge is moved past the wiper blade cleaning assembly 15, recess 17 in the heat sink 13 engages the spring-loaded temperature sensor 35 and senses the temperature thereof. In order for the printhead to eject nozzle-clearing droplets on the collection surface 33, to become capped, or to get primed while capped, the temperature of the printhead is measured by the spring-loaded temperature sensor 35 which is automatically seated into the recess 17 of the printhead's heat sink 13.

Figure 2:
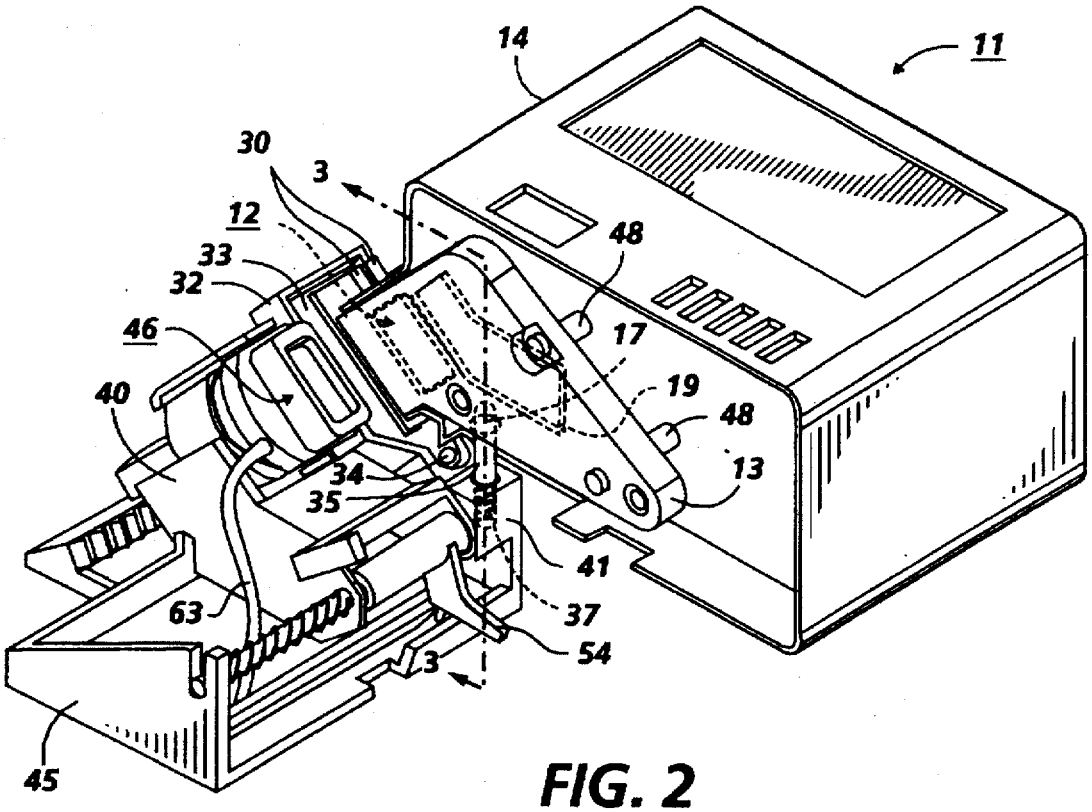
FIG. 2 is an isometric view of the replaceable cartridge assembly positioned for temperature sensing by the spring-loaded temperature sensor in the partially shown maintenance station.
Figure 3:
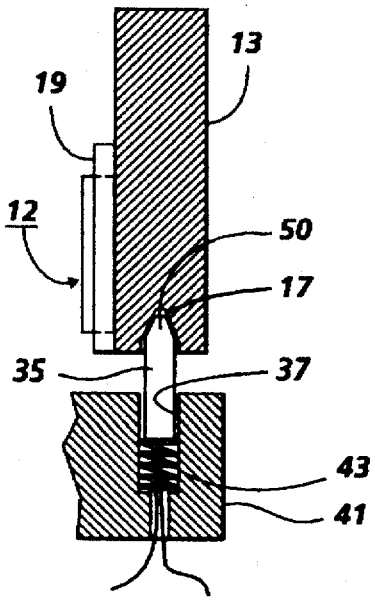
FIG. 3 is a cross-sectional view of the spring-loaded temperature sensor engaged with the heat sink and structural substrate for the printhead which is bonded thereto as viewed along view line 3—3 of FIG. 2.

Referring to FIGS. 2 and 3, the cartridge assembly 11 is positioned in the partially shown maintenance station 28 at a location for ejection of nozzle-clearing droplets by the printhead 12, shown in dashed line. The bottom cover (not shown) of the cartridge has been removed to expose the heat sink 13, which is fixed to the bottom of the cartridge by a combination of adhesive and staked posts 48. On the surface of the heat sink opposite the one shown in FIG. 2, the printhead 12 and printed circuit board 19 both shown in dashed line are bonded thereto and connected together by wire bonds (not shown). For a more detailed explanation of the cartridge 14, refer to U.S. Pat. No. 5,289,212, which reference is incorporated herein by reference. The spring-loaded temperature sensor 35 resides in a circular recess 37 in shelf 41 which is an integral portion of structural member 32. A spring 43 urges the temperature sensor in a direction parallel with and away from the recess 37. FIG. 3 is a cross-sectional view of the temperature sensor 35 engaged in recess 17 of the heat sink 13 as viewed along section line 3—3 of FIG. 2. In order to help guide the distal end portion 50 of the temperature sensor into seated position in the heat sink recess 17, either the temperature sensor end portion 50 or the heat sink recess 17 or both may be tapered. In the preferred embodiment, they are both tapered, as shown in FIG. 3. At the urging of spring 43, the temperature sensor is pushed into the heat sink recess until it makes an interference contact. Optionally, a thermal grease (not shown) is used to fill the heat sink recess 17 or to coat the temperature sensor end portion 50, in order to improve thermal contact. For the stationary temperature sensor 35, as shown in FIGS. 2 and 3, the temperature will only be accurately known when the printhead heat sink is in contact therewith. In addition to temperature sensing when the printhead enters the maintenance station 28 for routinely scheduled service, the printer controller may be programmed to bring the printhead's heat sink into contact with the temperature sensor at other predetermined periodic times, such as, for example, after a specific amount of printing by the printhead or after each page is printed. Such a periodic temperature sensing would greatly improve the accuracy of the heat management control of the printhead versus configurations in which the temperature sensor is always remote from the printhead and senses only ambient temperature.

In some applications it may be advantageous to design the temperature sensor to come into contact with the printhead heat sink when the cartridge is in a different location that that shown in FIG. 2. For example, the maintenance station may be alternatively designed such that the sensor is pushed into contact with the heat sink at a location (not shown) which does not require that the printhead face be wiped each time it is desired to take a temperature measurement.

For the case of multiple printheads (such as would be used in a color printer), multiple spring-loaded temperature sensors (not shown) are employed to align with corresponding heat sinks, or a single sensor which is sequentially brought into contact with each successive heat sink.

Any other suitable means, such as a solenoid, for bringing the temperature sensor into contact with the printhead's heat sink may be used. Generically, what is described herein is a temperature sensor which does not travel with the printhead cartridge assembly as it is scanned across the paper to print, but which is approached by the cartridge assembly at or near the end of travel, so that it may be actuated to come into good thermal contact with the printhead periodically.

Many modifications and variations are apparent from the foregoing description of the invention, and all such modifications are intended to be within the scope of the present invention.

We claim:

1. An ink jet printer having a printhead assembly which includes at least a printhead bonded to a heat sink, the printhead having at least one row of nozzles for ejecting ink therefrom onto a recording medium during a print operation, the printer further comprising:

a printhead temperature sensing station wherein a temperature sensor is movably mounted, a carriage means for moving said printhead assembly parallel to said recording medium during said print operation and for periodically moving said printhead assembly into said printhead temperature sensing station, means for moving said temperature sensor from a fixed position normally out of contact with said printhead assembly into a position wherein the sensor is in physical contact with the printhead heat sink, and means for generating an electrical signal corresponding to the temperature of the heat sink sensed by the temperature sensor, the heat sink temperature being substantially the same as the printhead temperature.

2. The printer of claim 1, wherein the means for moving the temperature sensor into contact with the printhead assembly is a spring and wherein the temperature sensor is urged into firm contact with the heat sink of the printhead assembly.

3. The printer of claim 2, wherein the heat sink of the printhead assembly has a recess for receiving the temperature sensor.

4. The printer of claim 3, wherein the heat sink recess and temperature sensor have complementary tapers to provide an interference contact therebetween.

5. The printer of claim 4, wherein the temperature sensing station is located in a maintenance station for servicing the printhead.

* * * * *